United States Patent [19]

Weis

[11] Patent Number: 4,925,170

[45] Date of Patent: May 15, 1990

[54] OVERHEAD FRAME FOR A FOLDER

[75] Inventor: Anton Weis, Lorsch, Fed. Rep. of Germany

[73] Assignee: Albert-Frankenthal AG, Frankenthal, Fed. Rep. of Germany

[21] Appl. No.: 272,707

[22] Filed: Nov. 17, 1988

[30] Foreign Application Priority Data

Dec. 3, 1987 [DE] Fed. Rep. of Germany ..... 3740923
Apr. 9, 1988 [DE] Fed. Rep. of Germany ..... 3811909

[51] Int. Cl.[5] ..... B41F 13/58
[52] U.S. Cl. ..... 270/5; 270/20.1
[58] Field of Search ..... 270/4–8, 270/20.1, 21.1, 41, 42; 101/226–228

[56] References Cited

U.S. PATENT DOCUMENTS

| | | | |
|---|---|---|---|
| 2,920,887 | 1/1960 | Keightley | 270/5 |
| 4,519,594 | 5/1985 | Weschenfelder | 270/20.1 |
| 4,538,517 | 9/1985 | Michalik | 270/21.1 |
| 4,725,050 | 2/1988 | Fujishiro | 270/5 |

FOREIGN PATENT DOCUMENTS

| | | | |
|---|---|---|---|
| 3501389 | 7/1986 | Fed. Rep. of Germany | 270/5 |

*Primary Examiner*—Robert E. Garrett
*Assistant Examiner*—Therese M. Newholm
*Attorney, Agent, or Firm*—Collard, Roe & Galgano

[57] ABSTRACT

In the context of an overhead frame for a folder placed transversely on the delivery end of a web-feed printing press comprising a set of adjustable first angle bars running transversely in relation to the direction of feed of the paper web and arranged to cause a change in the direction of ribbons supplied to the folder intake at least during magazine production, and a second, further set of second angle bars offset in relation to the first set of angle bars and which during production using a former for the ribbons deflect the web ribbons to at least one fold former during former production, and draw, register and angle bars it is possible to achieve a simpler design, short paper paths and greater ease of operation if the design is such that second angle bars and bend rolls, which are used as an alternative to the second angle bars extend parallel to the folder intake, are offset in relation to the first angle bars (which are used during forming and magazine production) in the same direction as the folder intake offset in relation to the first angle bars transversely in relation to the direction of paper feed in the press and between the first angle bars and the second angle bars or, respectively, the bend rolls, used alternatively thereto, for magazine production the draw and register rolls are provided which are also parallel to the folder intake, and there are bend rolls, running transversely in relation to the folder intake, for former production, which bend rolls are associated with the second angle bars and are offset in relation to the latter in the longitudinal direction of the printing press.

8 Claims, 3 Drawing Sheets

OVERHEAD FRAME FOR A FOLDER

BACKGROUND OF THE INVENTION

The invention is concerned with printing room equipment and is more particularly centered on systems designed for folding products using a fold former or alternatively for magazine production.

The invention specifically relates to an overhead frame for a folder placed transversely on the delivery end of web-feed printing press comprising a set of adjustable first angle bars running transversely in relation to the direction of feed of the paper web and arranged to cause a change in the direction of ribbons supplied to the folder intake at least during magazine production, and a second set of second angle bars offset in relation to the first set of angle bars and which during production using a former for the ribbons deflect the web ribbons to at least one fold former, and draw, register and angle bars.

In the overhead frames now conventionally used for folders of the above described type the intake of the folder is at of the median longitudinal plane of the feeding printing press. The first and the second angle bars are accordingly arranged one after the other in the working direction of the printing press and are used alternatively. In order to ensure sufficient accessibility of the angle bars arranged in sequence it is necessary to have a large free passage therebetween. This results in a long paper feed paths and makes the draw-in of the paper awkward. A further fact is in this respect that both the first angle bars and the second angle bars used alternatively thereto have to be laterally adjustable in order to adapt their setting to the position of the paper, something that makes the structure involved and expensive. A further particular disadvantage of this known arrangement is to be seen in the fact that in it the paper paths for former production and magazine production are quite different. It is thus necessary to provide draw and register rolls for the two types of production, this further increasing the structural complexity and impairing the draw-in of the paper.

SHORT SUMMARY OF THE INVENTION

Taking this state of the art into account one object of the invention is to devise a folder overhead frame of the initially described type which is comparatively simple and cheap in price.

A further aim of the invention is to provide such a frame that is comparatively easy to operate.

In order to achieve these or other aims appearing from the present specification and claims, the second angle bars and bend rolls, which are used as an alternative to the second angle bars extend parallel to the folder intake, are offset in relation to the first angle bars (which are used during former and magazine production) and set in the same direction as the folder intake offset in relation to the first angle bars transversely in relation to the direction of paper feed in the press and between the first angle bars and the second angle bars or, respectively, the bend rolls, used alternatively thereto, for magazine production the draw and register rolls are provided which are also parallel to the folder intake, and there are bend rolls, running transversely in relation to the folder intake, for former production, which bend rolls are associated with the second angle bars and are offset in relation to the latter in the longitudinal direction of the printing press.

These measures make it possible to completely overcome the disadvantages of the known arrangement. Since thefirst angle bars are used both for former and also for magazine production, it is sufficient if only the first angle bars are able to be laterally adjusted. There is the advantage that the second angle bars may be fixed in place and not able to be adjusted in relation to each other, this feature meaning a considerable structural simplification. A further advantage of the invention is to be seen in the fact that the draw-in and register rolls arranged with a lateral offset in relation to the first angle bars may be used both for former and also for magazine production so that only one set of draw-in and register rolls is required, this also simplifying the structure of the system. At the same time the number of bend rolls is reduced as well. A further feature is that the laterally offset first and second angle bars and bend rolls are accessible from the front without mutual hindrance, this facilitating the draw of the paper to a not inconsiderable extent. In this connection the small number of rolls also has an advantageous effect.

In accordance with an advantageous further development of the invention all the paper guiding means in the form of the first and second angle bars, the register rolls and the bend rolls may be arranged in a cantilever manner, such a cantilever arrangement leading to a particularly simple paper draw-in action.

According to an advantageous development of the invention it is possible to provide a side wall, which is offset in a direction parallel to the side walls of the printing press, to accommodate the bend rolls for former production and a side wall, which extends transversely to the side walls of the printing press, projects to one side past the extent of the printing press and supports the draw-in and register rolls, the mutually offset, nonadjustable second angle bars and the bend rolls for magazine production. These features lead to a reliable bearing system for all the stationarily arranged paper guiding means. Such means are in this respect at least partly arranged in a cantilever manner, this again facilitating paper draw-in.

In accordance with a further convenient feature of the invention the second angle bars, which are arranged stationarily above the level of the folder intake, and the bend rolls, also arranged stationarily, for magazine production, are arranged with a mutual lateral offset preferably in the vicinity of different sides of the third side wall provided with an access window. The stationary arrangement provided in this case of the second angle bars and the bend rolls, able to be used as an alternative thereto, for magazine production leads to a particularly simple structure. At the same time there is then no need to have any sort of adjustment when getting the plant ready for former production after a magazine run.

A further and particularly preferred embodiment of the invention is possible in which the second angle bars and the bend rolls used alternatively thereto for magazine production are mounted on a pivoting member, preferably able to be pivoted about a vertical axis, so that the said bars and rolls are placed opposite to each other. These measures lead to a particularly compact design and ensure particularly simple web draw-in both for former and also for magazine production, since it is in neither case that the elements only required for the respective other type of production have to be removed and instead it is only necessary for them to be swung out of the ribbon path.

It is furthermore convenient if the pivoting member has an angular configuration open towards the angle bars. This leads to the advantage of being able to have bearings at both ends of the angle bars.

In accordance with a further advantageous feature of the invention a sliding cassette is provided at the level of a line running between in the folder intake and the second angle bars, such cassette having at least one fold former and bend rolls which are parallel to the intake and are able to be bought into position as an alternative to the fold former by displacement of the cassette, above the folder intake, which bend rolls are able to be moved into place so as to be partly over adjacent draw rolls and partly over the magazine production bend rolls which are offset in parallelism in relation to the draw rolls. These features involve a considerable simplification of get ready for magazine or for former production by simply shifting the cassette.

Further features and advantages of the invention will be seen from the following account of one working embodiment thereof referring to the accompanying drawings.

LIST OF THE FIGURES OF THE DRAWINGS

DETAILED DESCRIPTION OF WORKING EXAMPLE OF THE INVENTION

Figure 1:
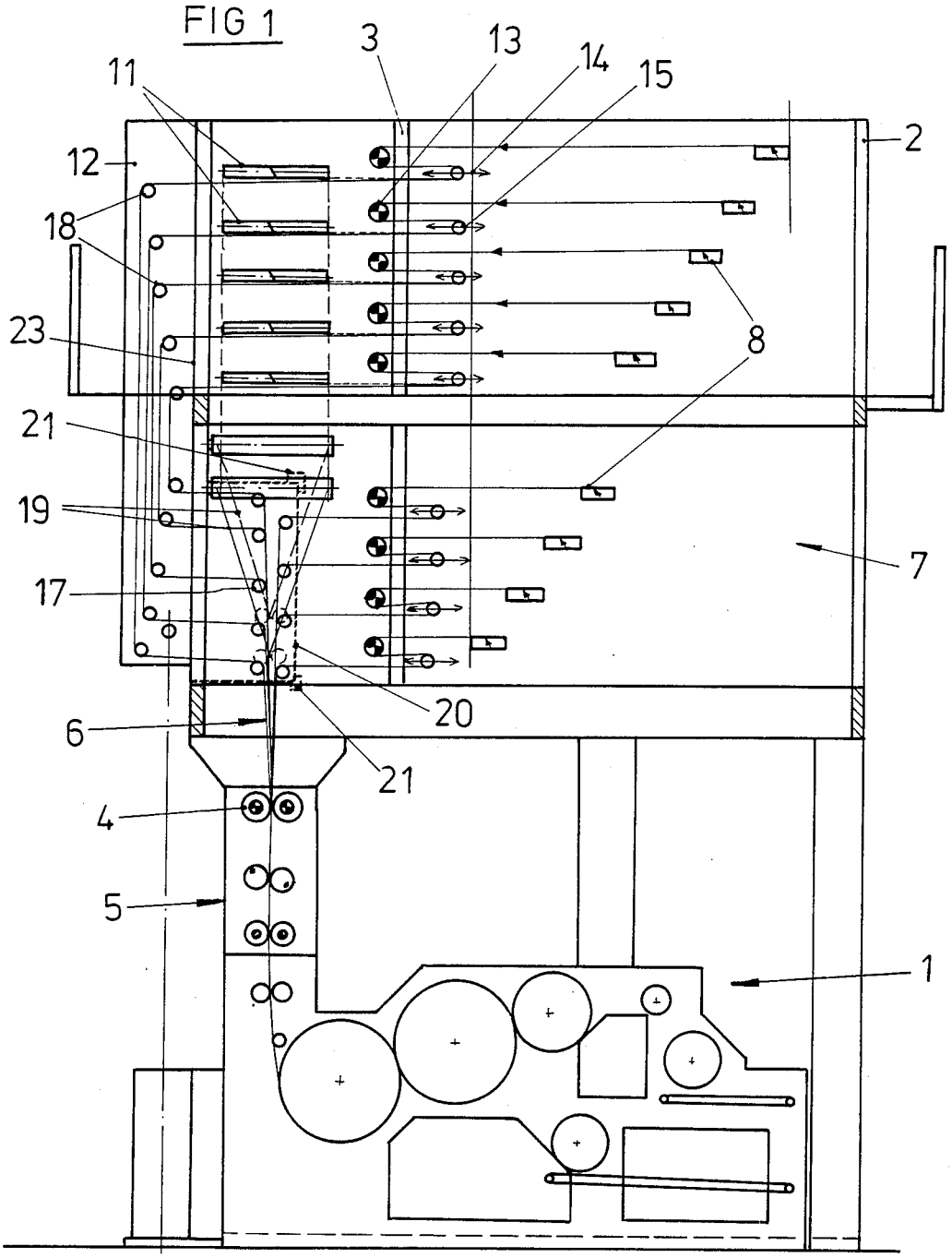
FIG. 1 is a diagrammatic view of an overhead folder frame in accordance with the invention in the condition gotten ready for magazine production.

The basic structure and manner of operation of a web feed printing press and of a folder placed on the delivery side thereof are well known. The folder 1 to be seen in FIG. 1 is arranged transversely in relation to the longitudinal direction of the printing press whose products are to be folded. Only the side walls 2 and 3 of the folder are indicated, that is to say the delivery direction of the folder 1 is at a right angle to the direction of feed of the paper web in the printing press. The folder 1 possesses an intake 5 with draw rolls 4 to which a set 6 of ribbons is fed. Like the draw rolls 4 the further rolls and the cylinders of the folder 1 extend in the feed direction of the printing press, that is say at a right angle to the cylinders and rolls of the printing press. The set 6 of ribbons includes a plurality of ribbons 6b placed in vertical alignment, such ribbons being produced by longitudinal cuts in the paper web 6a printed. During magazine production it is a question of single-breadth, loosely superposed ribbons. In the case of former production it will be a case of double-breadth ribbons provided with a longitudinal fold produced by the former.

The folder 1 is placed under an overhead frame 7, which is provided with guide parts for the individual ribbons. The folder 1 is in this respect so arranged that its intake 5 is laterally offset in relation to the median longitudinal plane of the printing press. Adjacent to the point of delivery of the paper web from the printing press the overhead frame 7 possesses first angle bars 8, which are mutually offset in height and which are responsible for changing the feed direction of the ribbons running thereover through 90° and for arrangement of the ribbons so that they are vertically aligned with each other. In the illustrated working example of the invention there are nine first angle bars 8, that is to say the paper web may be cut up into nine ribbons. The first angle bars 8 are, as will be best seen from FIG. 2, designed in the form of high speed angle bars. These bars are able to be adjusted transversely in relation to the feed direction of the incoming paper web. For this purpose the first angle bars 8 are provided with crosspieces 9 secured to the side walls 2 and 3 of the printing press and, respectively, extensions of these side walls. On each of these crosspieces a first carriage 10 provided with a first angle bar is mounted so that it may be displaced.

Figure 2:
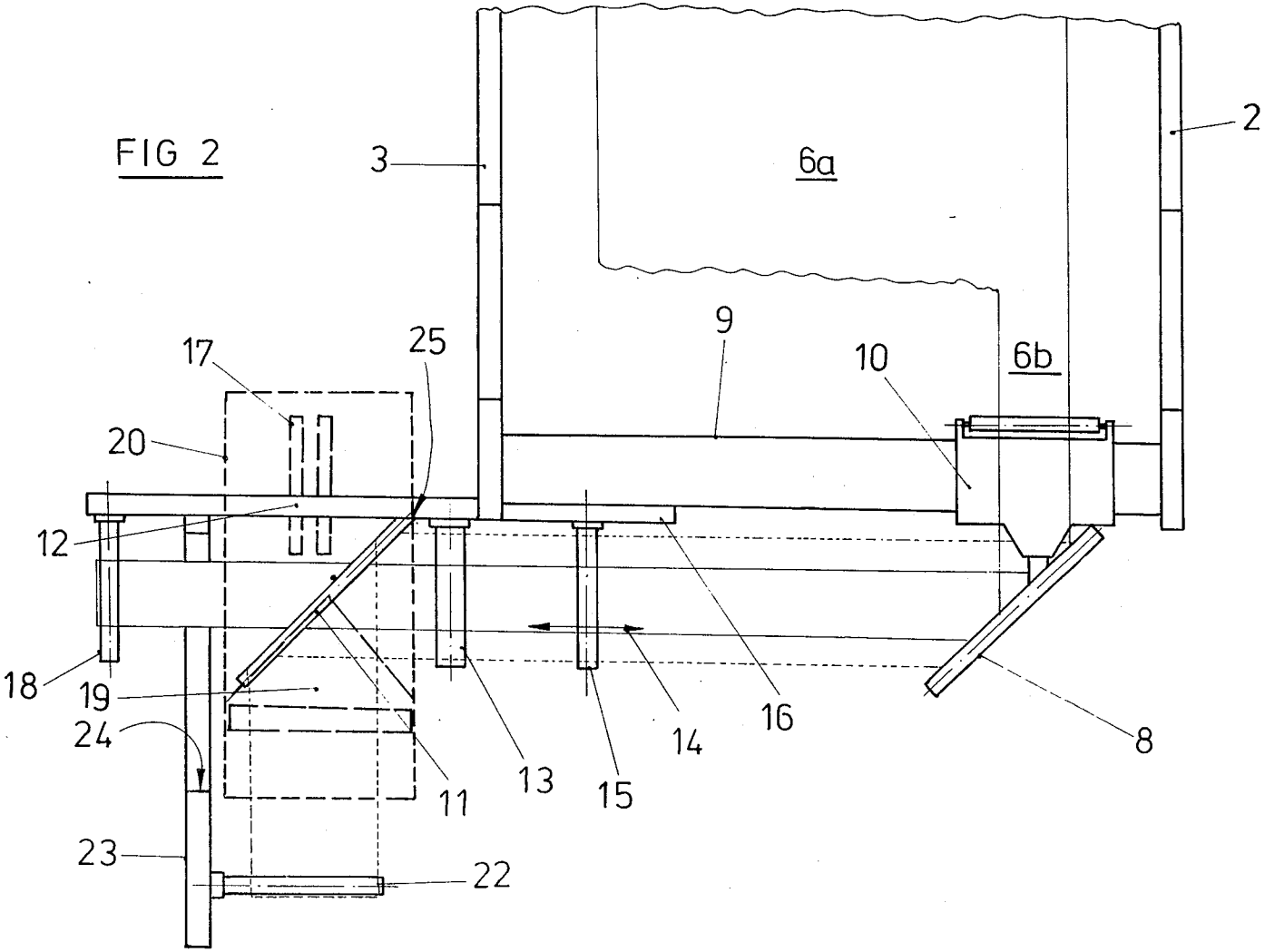
FIG. 2 is a diagrammatic plan view of the overhead folder frame as in FIG. 1 but after being made ready for former production.

For production using the former there are furthermore five second angle bars 11, which are offset in relation to the upper five first angle bars 8 laterally, that is to say in a direction transversely in relation to the direction of feed of the paper web delivered by the printing press. The amount of this lateral offset is so selected that the second angle bars 11 are located outside the deflection path of the first angle bars 8, that is to say at least laterally outside the working zone of the printing press. In the illustrated working example of the invention the offset is so selected in amount that the second angle bars 11 are laterally clear of the plane of the juxtaposed side wall 3. With the aid of the second angle bars 11 it is possible to cause a further 90° deflection or change in the direction of the fed paper webs as indicated in FIG. 2 in broken lines so that the paper ribbons running from the second angle bars 11 again run parallel to the paper web of the printing press but laterally offset thereto. The second angle bars 11 may, as is further indicated in FIG. 2, also be designed as cantilever mounted high speed angle bars. Unlike the laterally adjustable first angle bars 8, which are arranged at the delivery of the printed web from the press, the second angle bars 11 are not able to be laterally adjusted but are fixed in relation to each other. In the design of FIGS. 1 and 2 there is a fixed or stationary arrangement above the intake 5 of the folder. In order to mount the second angle bars 11 arranged stationarily in this case, there is an end wall 12 extending transversely in relation to the machine's side walls 2 and 3. This end wall 12 may be simply mounted at 90° on one of these side walls, in the present case the side wall 3, adjacent to the rear end of the side walls.

A drive draw roll 13 and a register roll 15 placed after it and able to be moved backwards and forwards as indicated by the arrow 14, are arranged in the runoff direction of the ribbons adjacent to each first angle bar 8. These draw and register rolls 13 and 15 are thus located, see FIGS. 1 and 2, between the first angle bars 8 and the stationary second angle bars 11 offset in relation to the first bars 8. As FIG. 2 further indicates these draw and register rolls 13 and 15 may also be cantilever paper guide members. The draw rolls 13 may like the second angle bars 11 may be mounted on the end wall 12. The adjustable register rolls 15 are mounted on guides 16 which are also mounted on the side wall 3 of the folder and are aligned with the end wall 12.

During magazine production the ribbons which are deflected by the first angle bars 8 and are marked in full lines in FIG. 2, are supplied to the intake 5 of the folder 1 without any longitudinal cut. In this case bend rolls 17 are offset from each other in height and are placed over the intake 5. One such ribbon runs over each such roll 17. The bend rolls 17 are aligned in parallelism to the draw rolls 13 and register rolls 15, over which the ribbons deflected by the first angle bars 8 also run. In order to economize in height there are two rows of bend rolls 17 which flank the middle plane of the intake of the folder, and these rolls are approached from the right and left, respectively. The bend rolls 17 associated with the draw rolls 13 are supplied with web via the four lower draw rolls 13 and, respectively, the register rolls 15 placed thereafter. The bend rolls 17 of the opposite row are supplied via the five upper draw rolls 13 and, respectively, register rolls 15, the guidance of the respective ribbons past the intake of the folder being performed by bend rolls 18 which are parallel to the bend rolls 17 and, respectively, the draw and register rolls 13 and 15.

In the design of FIGS. 1 and 2 with stationary second angle bars 11 the ribbons running off the five upper first angle bars 8 and, respectively, the rolls 13 adjacent thereto and the register rolls 15, are deflected past the stationary second angle bars 11 and laterally past same and then downwards and then inwards again to the bend rolls 13. For this purpose there are bend rolls 18 which are in this case also stationary at the side, remote from the draw rolls 13, of the second angle bars. In order to produce the desired number of parallel turns it is necessary to have for each ribbon two such bend rolls 18 placed one over the other. In the case of the design of FIG. 2 these rolls 18 are also mounted cantilever-fashion on the wall 12.

During former production the bend rolls 17 provided over the intake 5 of the folder are replaced by one or more fold formers 19. In the illustrated working example of the there are, as marked in FIG. 1, two fold formers 19. In order to facilitate change over from magazine production to former production there is a cassette 20 arranged over the intake 5 of the folder and which comprises the fold formers 19 and the bend rolls 17 used alternatively thereto and which may be so moved along a longitudinal guide 21 provided on the overhead frame 7 that in a first working position the fold formers 19 and in a second working position the bend rolls 17 are over the intake 5 of the folder. The longitudinal guide 21 for the cassette 20 runs, as will be seen from FIG. 1, perpendicularly to the plane of the drawing, that is to say parallel to the longitudinal direction of the printing press and of the axial direction of the rolls and cylinders of the folder 1. The end wall 12 is, as will further be seen from FIG. 2, provided with an access window 25 through which the sliding cassette 20 may pass.

The ribbons supplied to the fold formers 19 run parallel to the length direction of the printing press. The ribbons deflected by means of the first angle bars 8 through 90° are deflected through a further 90° bend by being fed to second angle bars 11 and they are fed, as will best be seen from FIG. 2, to the fold formers 19 which are offset in relation to the second angle bars 11. These bend rolls 22 are here also cantilever mounted. In order to mount the bend rolls 22 normal to the draw rolls 13 the overhead frame 7 has a side wall 23 which is parallel to the folder sides walls 2 and 3 and abuts the end wall 12 at 90°. This side wall 23 is in FIG. 2 within the bend rolls 18 provided for magazine production and is in this case suitably provided with an access window 24 for the ribbons to be supplied past the stationary second angle bars 11 to the bend rolls 18 during magazine production.

Figure 3:
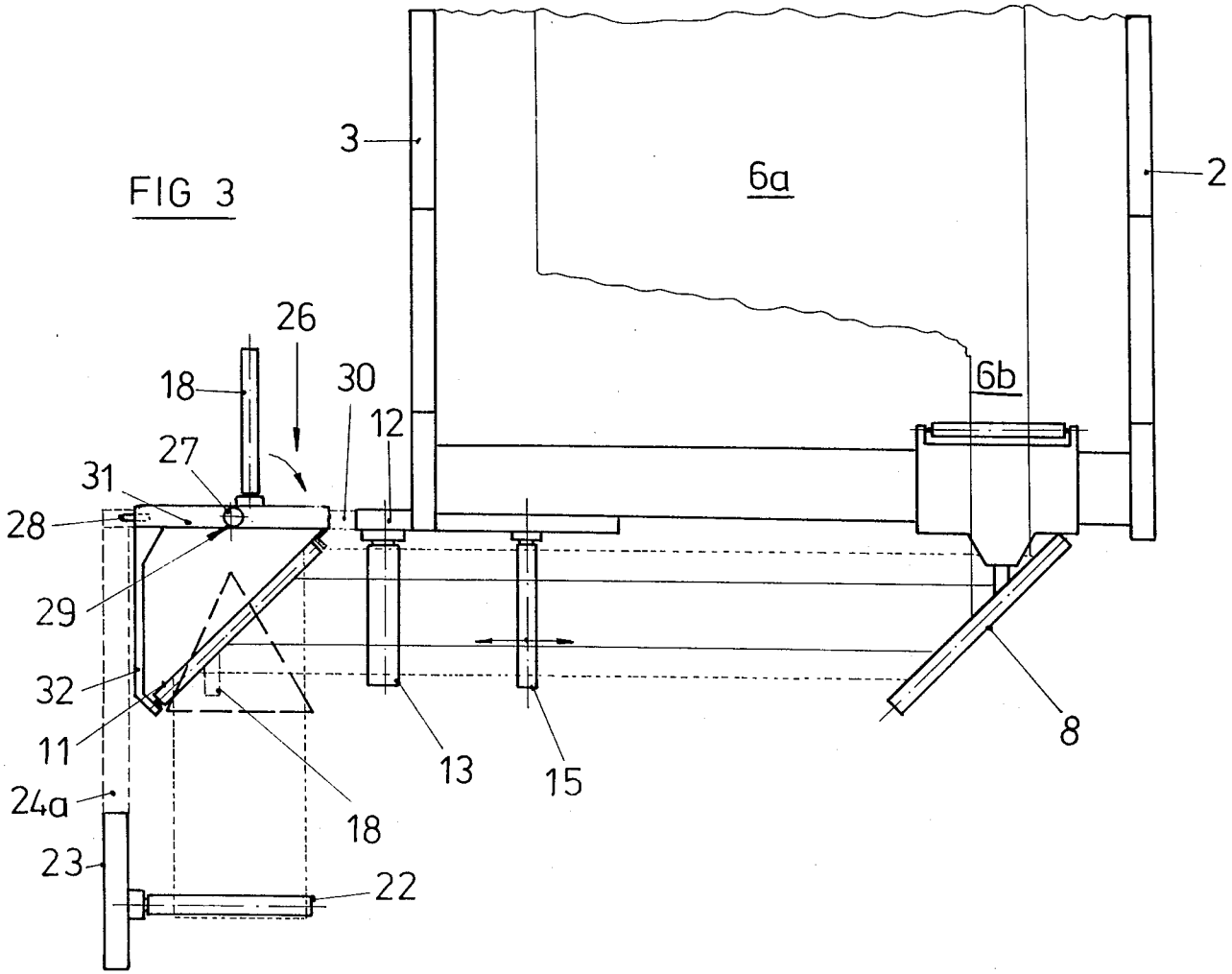
FIG. 3 shows a modification of the frame with a pivoting member in the position corresponding to FIG. 2.

The arrangement as shown in FIG. 3 does not differ in its basic structure and workings from the above described design with stationarily arranged second angle bars and bend rolls, used alternatively thereto, for magazine production. The following account is accordingly restricted to the departures in structure with like parts being denoted by like references.

In order not to have to run the paper ribbons over the second angle bars 11 during magazine production, that is to say in order to facilitate draw-in of the web during magazine production, in the design of FIG. 3 the second angle bars 11 and an equal number of bend rolls 18 used alternatively to the second angle bars during magazine production are mounted on a pivoting member 26 which swings about a vertical shaft 27. The second angle bars 11 and the bend rolls 18 for magazine production are in this respect mounted on opposite sides of the pivoting member 26 and may accordingly be arranged at approximately the same height. In order to make ready for magazine production after a former run, or vice versa, the pivoting member 26 is simply swung through 180°. In the case of former production the second angle bars 11, as indicated in FIG. 3, are generally arranged over the intake of the folder and during magazine production the bend rolls 18, indicated in FIG. 3 by broken lines are placed thereover. In both the working settings the pivoting member 26 is able to be locked in place by means of a catch 28. The guide means which is respectively not required, that is to say in FIG. 3 the bend rolls 18, extends downwards from the pivoting member 26 and is accordingly clear of the moving ribbons.

In the illustrated form of the invention the pivoting member 26 is designed in the form of a plate-like carrier provided with upper and lower journals 29. It is mounted to the side of the paths of the ribbons. In the illustrated working example the pivoting member 26 is arranged so as to be generally flush with the end wall 12. The latter may have a window 30 for the pivoting member 26. In order to provide a sufficient degree of pivot of the member 26 the third side wall 23 is also made with a window 24a through which the pivoting member 26 may be rocked.

The bend rolls 18 are cantilever mounted on the pivoting member 26. By the same token it is possible for the second angle bars 11 to be cantilever mounted. In the illustrated working example the second angle bars 11 have supporting bearings at both ends. The pivoting member 26 is for this purpose made with an angle cross section and on the plate-like carrier 31 having the journals 29 there is a wall 32 projecting at a right angle and so placed that there is an angular configuration open towards the second angle bars 11.

When the plant is made ready for magazine production the bend rolls 18, as marked in broken lines in FIG. 3, are placed directly over the intake of the folder. The ribbons running over these bend rolls 18 are accordingly not led past the intake of the folder and accordingly do not have to be led inwards again before reaching the intake of the folder. This leads to a corresponding decrease in the number of bend rolls 18 required to the number of ribbons, that is say number of bend rolls 18 in the design indicated in FIG. 1 is reduced to the number of ribbons. The number of the bend rolls 17 placed directly over the intake of the folder is also reduced, since a separate bend roll 17 is not required for each ribbon. The result is thus a particularly simply designed and compact overhead frame which is very simple to operate, that is to say the draw-in of the web is particularly simple.

What is claimed:

1. In an overhead frame for a folder placed transversely at the delivery end of web-feed printing press comprising a set of adjustable first angle bars running transversely in relation to the direction of feed of the paper web and arranged to cause a change in the direction of ribbons supplied to the folder intake at least during magazine production, a second, further set of second angle bars offset in relation to the first set of angle bars and which during production using a former for the ribbons deflect the web ribbons to at least one fold former during former production, and draw, register and angle bars, the improvement residing in that the second angle bars and bend rolls, which are used as an alternative to the second angle bars extend parallel to the folder intake, are offset in relation to the first angle bars, which are used during former and magazine production, in the same direction as the folder intake offset in relation to the first angle bars transversely in relation to the direction of paper feed in the press and between the first angle bars and the second angle bars and, respectively, the bend rolls, used alternatively thereto, for magazine production the draw-in and register rolls are provided which are also parallel to the folder intake, bend rolls, running transversely in relation to the folder intake, for former production, which bend rolls are associated with the second angle bars and are offset in relation to the latter in the longitudinal direction of the printing press, and parallel bend rolls which are adapted to be placed in position over the intake of the folder and under a zone with the second angle bars, such parallel bend rolls being arranged to be fed with web via juxtaposed draw-in rolls and partly via bend rolls offset from and parallel to the draw-in rolls, for magazine production, wherein the bend rolls aligned with the intake of the folder and the at least one fold former arranged to be placed alternatively over the intake of the folder are mounted on a carrier which is preferably adapted to be slid in the longitudinal direction of the printing press.

2. The structure as set forth in claim 1 wherein the pivoting member is bearinged to the side of the ribbons being fed through the structure and preferably in a window in the end wall.

3. The structure as set forth in claim 2 wherein the pivoting member, which is preferably able to be rocked through 180° is able to be locked in its working settings by means of a catch.

4. The structure as set forth in claim 3 wherein the pivoting member is fits into a window provided therefor in the third side wall.

5. The structure as set forth in claim 4 wherein the pivoting member has an angular configuration opening towards the second angle bars which are preferably supported at both ends thereof.

6. In an overhead frame for a folder placed transversely at the delivery end of web-feed printing press comprising a set of adjustable first angle bars running transversely in relation to the direction of feed of the paper web and arranged to cause a change in the direction of ribbons supplied to the folder intake at least during magazine production, a second, further set of second angle bars offset in relation to the first set of angle bars and which during production using a former for the ribbons deflect the web ribbons to at least one fold former during former production, and draw, register and angle bars, the improvement residing in that the second angle bars and bend rolls, which are used as an alternative to the second angle bars extend parallel to the folder intake, are offset in relation to the first angle bars, which are used during former and magazine production, in the same direction as the folder intake offset in relation to the first angle bars transversely in relation to the direction of paper feed in the press and between the first angle bars and the second angle bars and, respectively, the bend rolls, used alternatively thereto, for magazine production the draw-in and register rolls are provided which are also parallel to the folder intake, and there are bend rolls, running transversely in relation to the folder intake, for former production, which bend rolls are associated with the second angle bars and are offset in relation to the latter in the longitudinal direction of the printing press, an end wall running transversely in relation to side walls of the printing press, projects to one side past the extent of the printing press and is adapted to mount the draw-in and register rolls, the second angle bars which are not adjustable in relation to each other, and the bend rolls for magazine production, wherein the second angle bars and the bend rolls for magazine production are mounted on a pivoting member swinging on a preferably vertical shaft and preferably opposite each other.

7. The structure as set forth in claim 6 wherein in the case of a stationary arrangement of the bend rolls offset in relation to the second angle bars placed over the intake of the folder for magazine production under such bend rolls there are further bend rolls offset in parallelism to the bend rolls aligned with the intake of the folder.

8. An overhead structure for a folder (1) which is arranged to be supplied from a web-feed printing press and is arranged transversely in relation to the median longitudinal plane of the printing press, said folder being adapted to be switched over from former production, in which the ribbons of the web run over at least one former (19) arranged generally above the inlet (5) of the folder, into the inlet (5) of the folder, to magazine production, in which the ribbons of the web run over inlet rolls (17) placed generally above the inlet (5) of the folder, and consisting of:

a set of first angle or bend bars (8) arranged transversely in relation to the direction of running of the paper web and adjusted in the printing press, by way of which during former production and magazine production the ribbons of the web, which are supplied to the inlet (5) of the folder which is laterally offset in relation to the median longitudinal plane of the printing press, may be deflected, a set of second angle bars (11), which in relation to the first angle bars (8) are offset in the same direction as the inlet (5) of the folder and are only used during former production, bend rolls (18) adapted to be used as an alternative to the second angle bars (11) only during magazine production, and arranged to be parallel to the inlet (5) of the folder, said bend rolls (18) being arranged on the inlet side of inlet rolls (17) arranged adjacent the inlet (5) of the folder, tensioning and register setting rolls (13 and 15) provided between the first angle bars (8) and the second angle bars (11) or, respectively, between the bend rolls (18) adapted to be used as an alternative thereto, and placed so as to be parallel to the inlet (5) of the folder, further comprising:

the at least one former (19) provided and the inlet rolls (17) are adapted to be arranged alternatively generally above the inlet (5) of the folder, two rows of superposed inlet rolls (17) are provided, which during magazine production are on the two sides of the median plane of the inlet (5) of the folder, so that web ribbons supplied to the inlet rolls (17) remote from the first angle bars (8) are moved away by the bend rolls (18), which are adapted to be used alternatively to the second angle bars (11) and with respect to the median plane of the inlet (5) of the folder are arranged on the same side as the inlet rolls (17) which are associated with them and which are remote from the first angle bars (8), so as to bypass the second angle bars (11) via the inlet (5) of the folder, and in doing so are turned in parallel by two bend rolls (18) arranged over each other, and by means of bend rolls (22), which are arranged after the second angle bars (11), are offset in relation to the same in the longitudinal direction of the press and are transverse in relation to the inlet (5) of the folder, the ribbons of the web are able to be supplied to the at least one former during former production.

* * * * *